US006370692B1

(12) United States Patent
Duyn et al.

(10) Patent No.: US 6,370,692 B1
(45) Date of Patent: Apr. 16, 2002

(54) CONVERTIBLE OUTDOOR GARMET

(75) Inventors: Margaret Van Duyn; Debora J. Smith, both of Racine, WI (US)

(73) Assignee: LaCrosse Footwear, Inc., LaCrosse, WI (US)

( * ) Notice: Subject to any disclaimer, the term of this patent is extended or adjusted under 35 U.S.C. 154(b) by 0 days.

(21) Appl. No.: 09/603,371

(22) Filed: Jun. 26, 2000

Related U.S. Application Data

(60) Provisional application No. 60/209,941, filed on Jun. 7, 2000.

(51) Int. Cl.[7] ..... A41D 3/02

(52) U.S. Cl. ..... 2/86; 2/84; 2/202

(58) Field of Search ..... 2/86, 456, 69, 2/69.5, 88, 89, 84, 93–95, 97, 85, 108, 115, 202, 173, 207, 181.4; 224/576, 577

(56) References Cited

U.S. PATENT DOCUMENTS

| | | | | |
|---|---|---|---|---|
| 4,078,264 A | | 3/1978 | DeGennaro et al. | |
| 4,227,264 A | | 10/1980 | Spector et al. | |
| D277,048 S | | 1/1985 | Peyser | |
| 4,944,042 A | | 7/1990 | DeWan | |
| 5,206,958 A | | 5/1993 | Widenback | |
| 5,414,881 A | | 5/1995 | Terrazas | |
| 5,452,476 A | | 9/1995 | Jenks | |
| 5,564,125 A | | 10/1996 | Waldman et al. | |
| 5,628,065 A | * | 5/1997 | Austin | 2/81 |
| 5,713,077 A | * | 2/1998 | Humbrecht | 2/173 |
| 5,787,504 A | | 8/1998 | Wu | |
| 5,815,833 A | | 10/1998 | Kuo | |
| 5,832,538 A | * | 11/1998 | Williams | 2/202 |
| 5,850,634 A | | 12/1998 | Toombs | |
| 5,873,132 A | | 2/1999 | Grilliot et al. | |
| D414,013 S | | 9/1999 | Group | |
| 5,946,729 A | | 9/1999 | Sakurai et al. | |
| 6,126,507 A | * | 10/2000 | Lieberman | 446/327 |

* cited by examiner

*Primary Examiner*—John J. Calvert
*Assistant Examiner*—Tejash Patel
(74) *Attorney, Agent, or Firm*—Foley & Lardner

(57) ABSTRACT

A waterproof garment includes a jacket; and a hood which is convertible into a ventilated carrying bag for storing the jacket. A ventilated waterproof hood includes an inner ventilated material and an outer waterproof layer having an interior surface and an exterior surface. The outer waterproof layer includes at least two side portions; a top of the head portion abutting the side portions, the top of the head portion comprising a front of the head portion and a back of the head portion; a base of the neck portion; and a back portion, the back portion extending from the back of the head portion to the base of the neck portion and extending from one side portion to the other side portion. The inner ventilated material is attached to the back of the head and to the two side portions of the interior surface of the outer waterproof layer, and the inner ventilated material defines a ventilated pocket in the ventilated waterproof hood.

12 Claims, 10 Drawing Sheets

CONVERTIBLE OUTDOOR GARMET

This Application claim benefit to Provisional Application 60/209,941 Jun. 7, 2000.

FIELD OF THE INVENTION

The invention generally relates to a convertible article of clothing. More particularly, the invention relates to an outdoor garment having a waterproof hood that can be turned inside-out to serve as a ventilated carrying bag for the rest of the outdoor garment.

BACKGROUND OF THE INVENTION

Informed individuals who participate in outdoor activities are well aware of the fact that the weather is unpredictable. Such individuals know that weather conditions may quickly change from sunny and dry to stormy and wet without much warning time. Preparing for extended outdoor excursions often presents conflicting goals. For example, individuals packing for extended backpacking or hiking trips will want to minimize the amount of weight and space that is taken up in their carrying equipment. On the other hand, those acquainted with the importance of weather conditions on exposure and comfort, will understand the necessity of carrying spare dry clothes that can be changed into once an individual is out of the wet conditions.

Various types of outdoor garments are suited to different weather conditions. Those engaging in outdoor activities will recognize the necessity of carrying dry clothes to change into in the event wet weather is encountered. If the weather is windy and rainy, a head-to-toe waterproof suit is most desirable. However, if the day warms up and the sun comes out, one might desire to remove the waterproof suit and conveniently store it. In this situation, it is beneficial to avoid toting around heavy, clumsy spare bags solely for the purpose of storing the wet clothing. As those acquainted with outdoor activities will recognize, a carrying bag is required if the spare dry clothes are to be kept in their dry state.

Prior art discloses an outdoor garment consisting of a jacket with a removable hood which can be converted into a carrying bag. However, this prior art still has the drawback of storing wet clothes in a closed, warm, non-ventilated carrying sack which promotes the growth of mildew.

A need, therefore exists for a functional waterproof hood that converts into a ventilated carrying bag for the rest of the wet outdoor garment. The ventilated carrying bag will allow the wet clothes to dry quickly, preventing mildew growth, which inevitably results from storing wet clothing in a warm air-tight backpack. A need also exists for an outdoor garment that includes a hood that converts into a carrying bag for the garment.

SUMMARY OF THE INVENTION

The invention provides a waterproof hood that converts into a ventilated carrying bag for storage of the remainder of the outdoor garment. The ventilated carrying bag prevents mildew growth on the wet outdoor garment by exposing the garment to air. The invention also provides an outdoor garment that includes a hood that converts into a carrying bag for the garment.

Still further objects, features, and advantages of the invention will be apparent from the following detailed description when taken in conjunction with the drawings.

BRIEF DESCRIPTION OF THE DRAWINGS

The preferred exemplary embodiment of the invention will hereinafter be described in conjunction with the appended drawings, wherein like numerals denote like elements and.

DETAILED DESCRIPTION OF THE INVENTION

Figure 1:
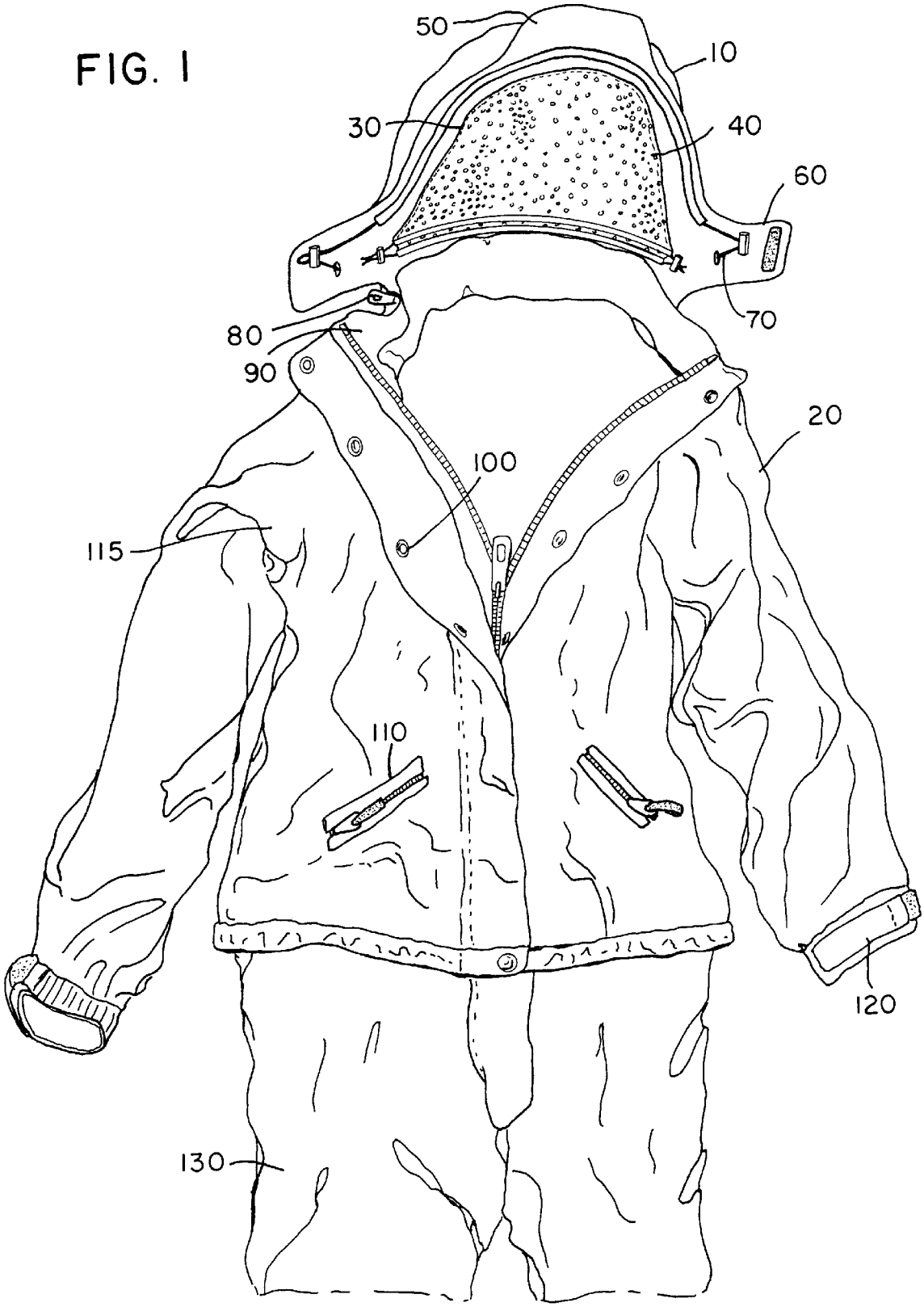
FIG. 1 is a front view of a jacket, pants, and hood in accordance with the present invention.

A waterproof outdoor garment includes a jacket and a hood which is convertible into a ventilated carrying bag for storing the jacket. When being used as a hood, the material exposed to the outer elements is waterproof in one embodiment, and may be made of any suitable material well known in the art. The waterproof hood is detachably attached to the jacket. The jacket and hood may be attached by a zipper, velcro, buttons, or any other suitable means for fastening well known in the art. In one embodiment, a collar on the jacket conceals the means for fastening portion on the jacket when the hood is detached.

The hood can be converted into a ventilated carrying bag. The carrying bag in one embodiment has a drawstring which acts as a handle for the carrying bag and can be cinched to keep the jacket snuggly held inside. The waterproof outdoor garment has an optional pair of waterproof pants, for which there is room in the carrying bag to be stored along-side the jacket. The pants' waistband may be adjustable by any means known in the art, including but not limited to, a nylon cord, velcro, and/or buttons. The outdoor garment's pants and jacket may be of the same color or different colors. The pants and jacket are made of any suitable material well known in the art, but are in one embodiment both made of waterproof material.

In one embodiment of the outdoor garment, the hood contains an outer layer that is waterproof. On its inside, the hood has ventilated material attached to at least a portion of the inner surface of the waterproof outer layer. This interior ventilated material portion of the hood comprises a pocket which forms the carrying bag when turned inside-out. The material of the ventilatory pocket inside the hood, which is the exterior of the carrying bag, is a nylon mesh material, a nylon cord weave, a pliable polymer braid or weave, or any other breathable material well known in the art. The hood for an article of clothing is detachably attached to a jacket and the jacket may be stuffed into the ventilated pocket of the hood. In one embodiment, the pocket of the hood comprises a bottom portion made of a waterproof material. Whereas in other preferred hoods, the pocket of the hood comprises a bottom portion made of ventilated material.

A ventilated waterproof hood of the present invention includes an inner ventilated material and an outer waterproof layer having an interior surface and an exterior surface. The outer waterproof layer includes at least two side portions; a top of the head portion abutting the side portions, the top of the head portion comprising a front of the head portion and a back of the head portion; a base of the neck portion; and a back portion, the back portion extending from the back of the head portion to the base of the neck portion and extending from one side portion to the other side portion. The inner ventilated material is attached to the back of the head and to the two side portions of the interior surface of the outer waterproof layer, and the inner ventilated material defines a ventilated pocket in the ventilated waterproof hood.

The present invention provides an easily convertible outdoor garment which protects its wearer from wind and water and serves as a functional carrying bag. The garment consists of a hood, jacket and optional pants. Whether detached from the jacket or not, the hood can be turned inside-out to form a breathable storage bag in which the wet jacket and optional pants can be stored. The storage bag's mesh-like material is such that it exposes its wet contents to the surrounding air in order to facilitate drying and prevent mildew build-up. The ventilated storage bag may be equipped with a drawstring which can be cinched to hold the jacket and optional pants inside and aid in their transport.

Referring to the drawings and more particularly to FIG. 1, there is shown a front view of a jacket 20, a hood 10, and a pair of pants 130. The garment shown is merely illustrative and the invention is not limited to a rainproof jacket but encompasses other configurations of waterproof garments such as capes, fleece, coat, parkas, wraps, and shawls. Furthermore, there is an unlimited array of waterproof materials which would satisfy the purpose of the claimed invention.

As shown in FIG. 1, jacket 20 includes an attached hood 10 with a mesh material lining inside 40. The hood further includes a visor 50 and a neck piece 60 which can be wrapped around the wearer's neck for additional warmth and protection from water. The neck piece 60 is secured in a closed position by Velcro. There is also a nylon cord 70 threaded along the face of the hood which can be tightened to keep wind and rain from entering the hood.

Figure 2:
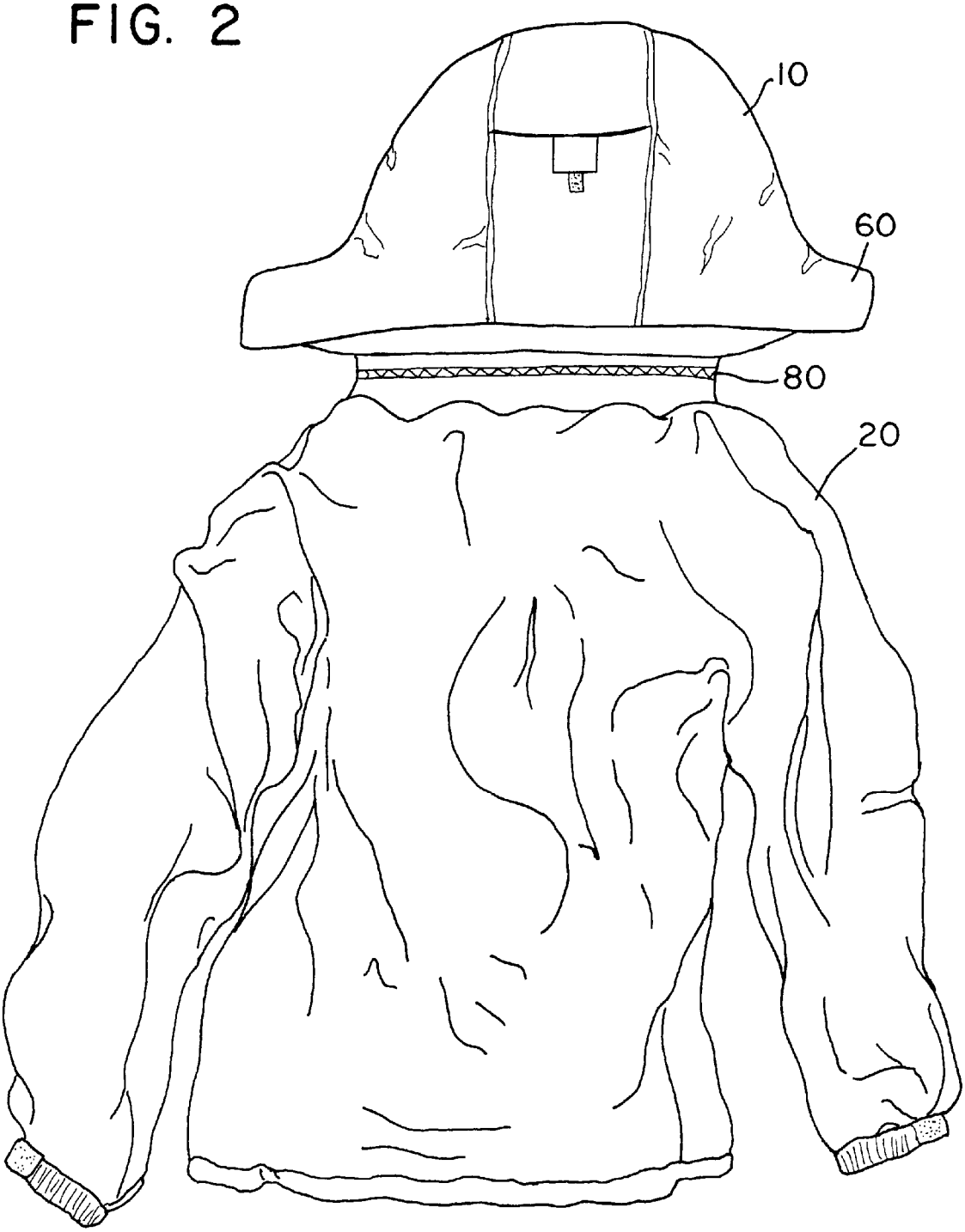
FIG. 2 is a rear view of the jacket and hood shown in FIG. 1 showing where the zipper connects the hood to the jacket in relation to the collar.

As shown in FIG. 1, the hood 10 is attached to the jacket 20 by a zipper 80. The zipper 80 is located behind the collar 90, which can be best viewed in FIG. 2. Jacket 20 further includes such conventional items as arm holes 115, Velcro fasteners to adjust the size of the wrist cuffs 120, two zipper pockets on either side of the front of the jacket 110, and an additional piece of material which covers the jacket's zipper and is secured by snaps 100. Furthermore FIG. 1 shows an optional pair of pants 130.

Figure 3:
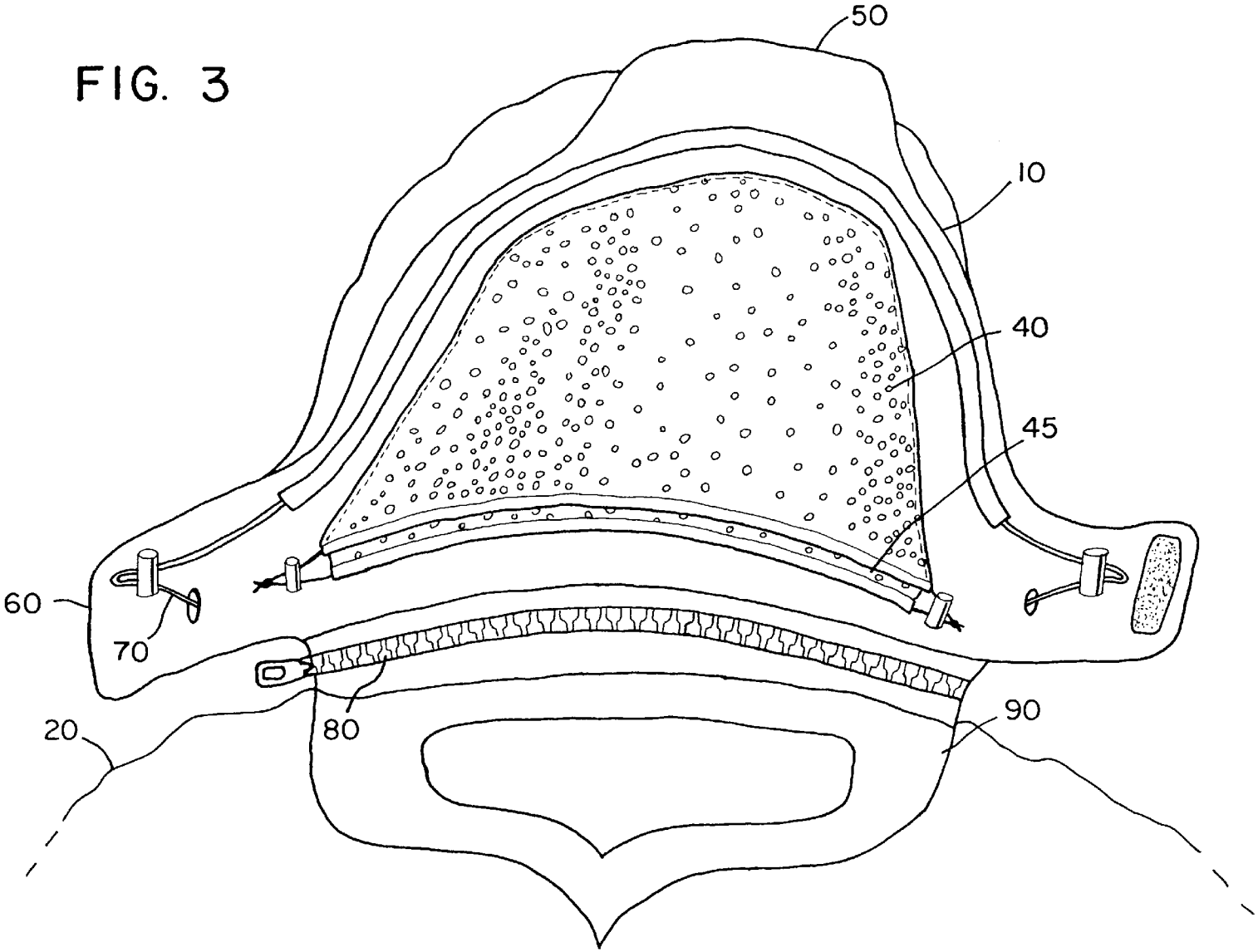
FIG. 3 is an enlarged front view of the hood shown in FIG. 1 showing the ventilatory material folded against the inside back of the hood.
Figure 4:
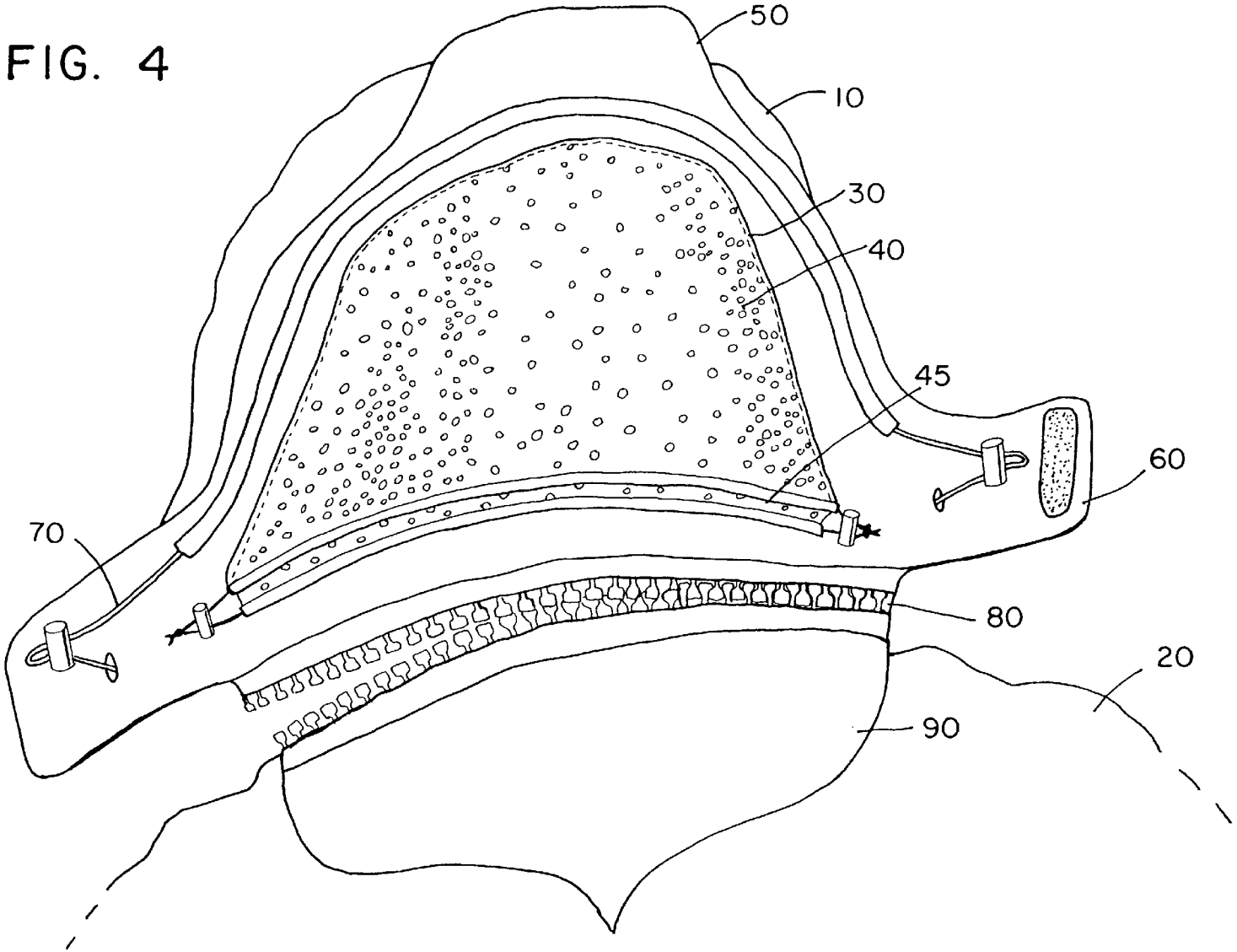
FIG. 4 is the front of the jacket and hood shown in FIG. 1 mid-way through the process of unzipping the hood from the jacket.
Figure 5:
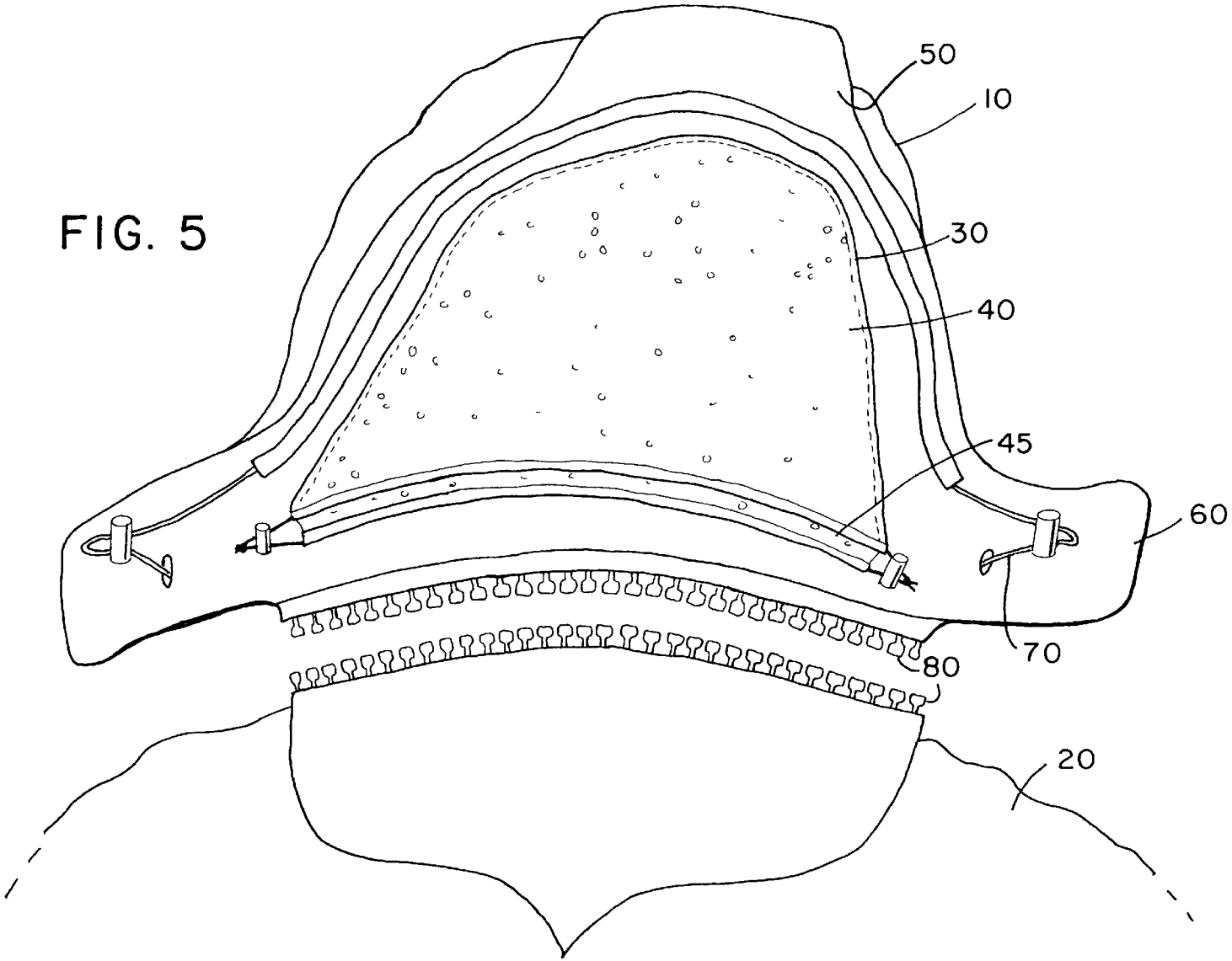
FIG. 5 is a front view of the hood shown in FIG. 1 detached from the jacket.
Figure 6:
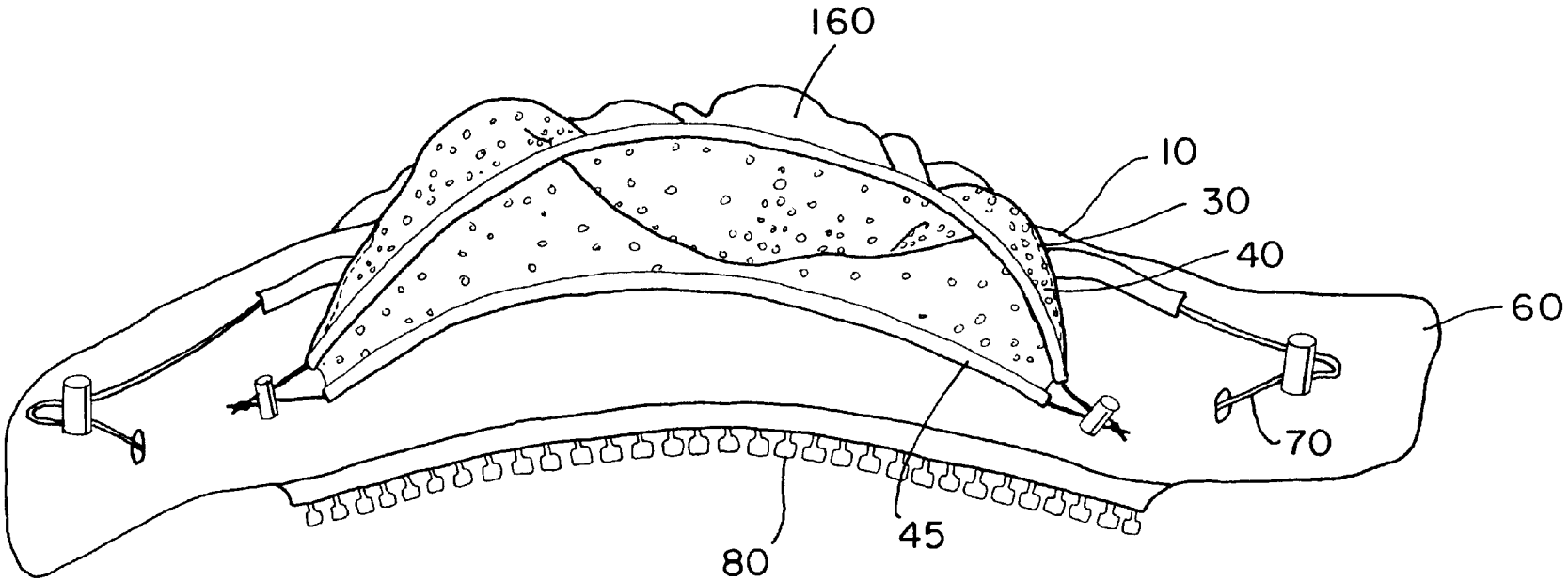
FIG. 6 is a front view of the hood shown in FIG. 1 showing how the top of the hood is pushed in to become the bottom of a carrying bag.
Figure 7:
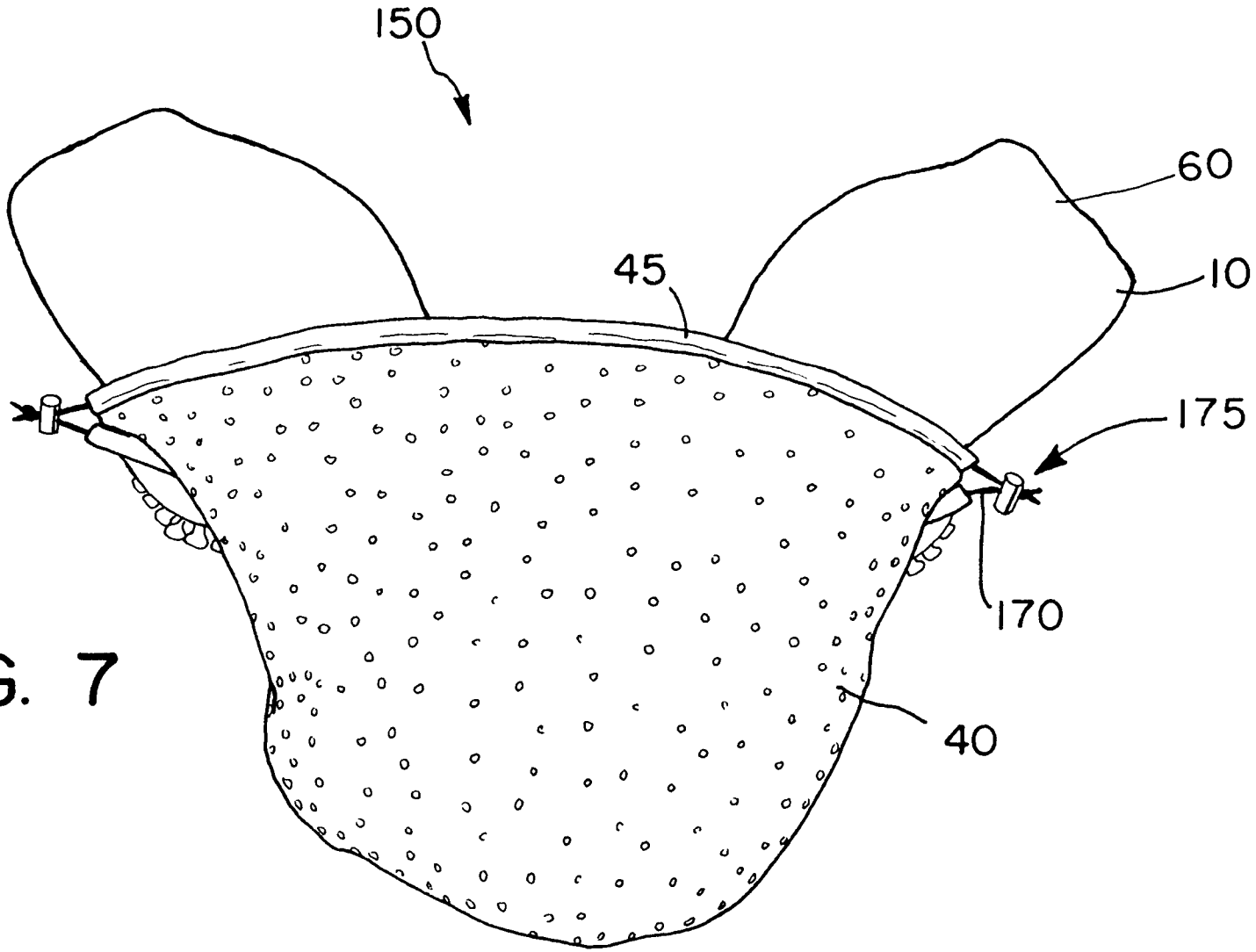
FIG. 7 is a front view of the hood shown in FIG. 1 showing how the exterior sides of the hood become the interior sides of the carrying bag.
Figure 8:
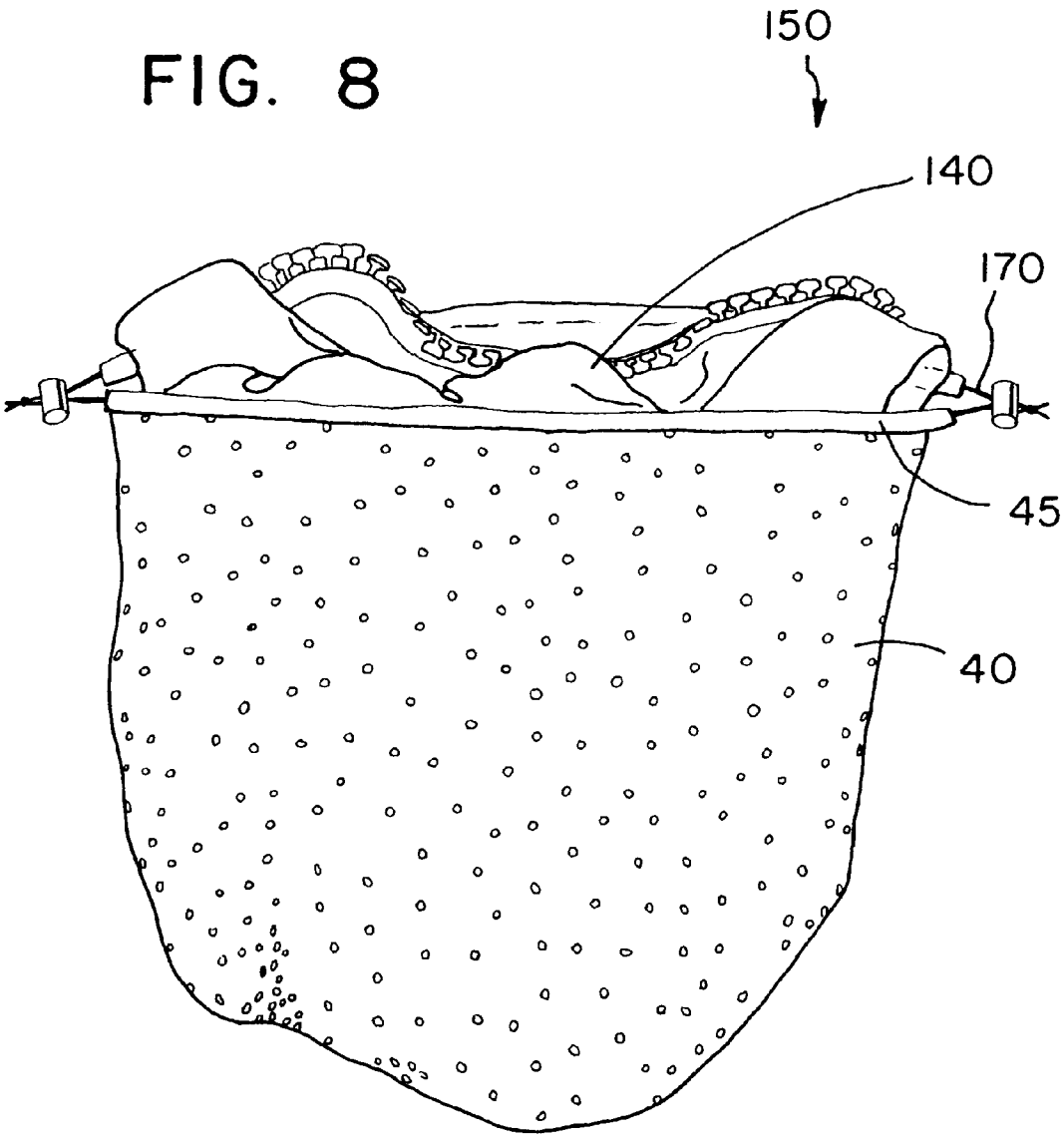
FIG. 8 is a top view showing the jacket and the pants shown in FIG. 1 folded inside the bag formed from the hood shown in FIG. 1.
Figure 10:
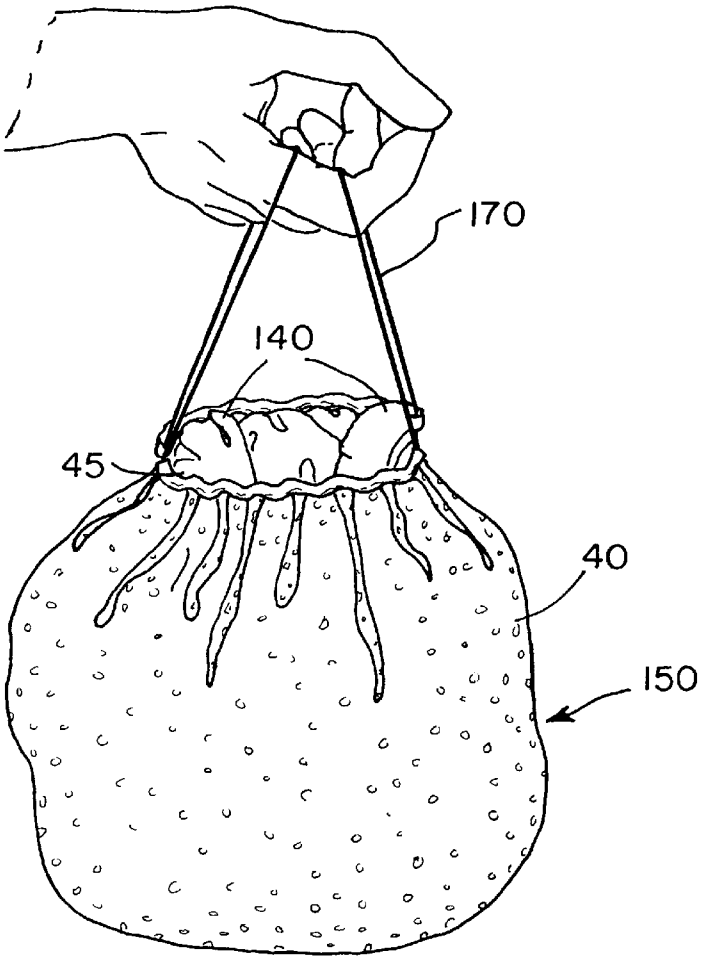
FIG. 10 is a front view of the bag formed from the hood shown in FIG. 1 containing the jacket and pants shown in FIG. 1 in the carrying position.
Figure 9:
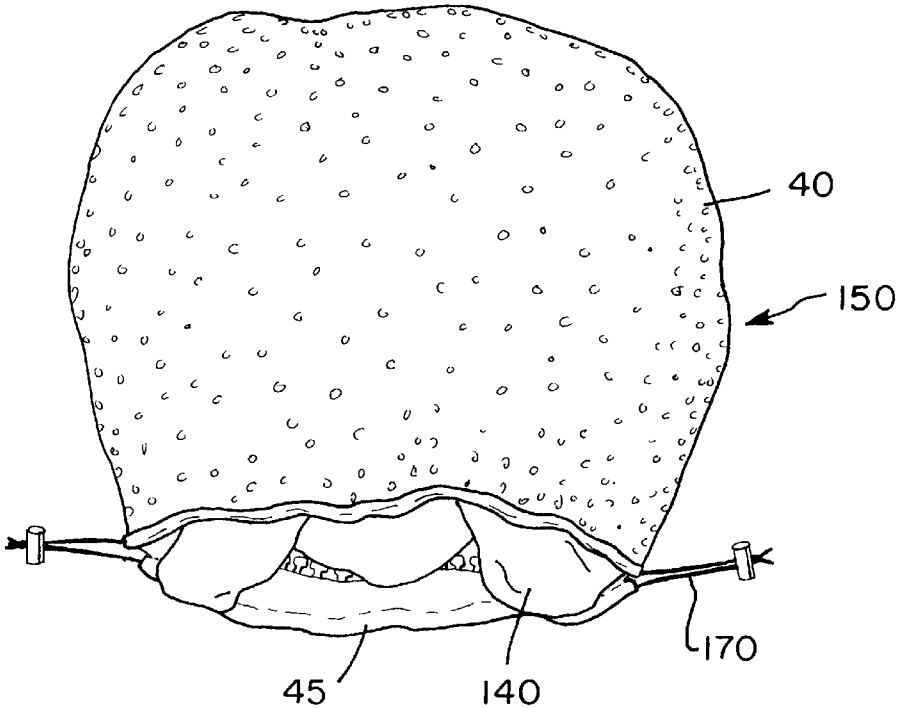
FIG. 9 is a top view showing how the bag is formed from the hood shown in FIG. 1 and the bag's drawstring which can be cinched with the jacket and pants shown in FIG. 1 inside the bag.
Figure 11:
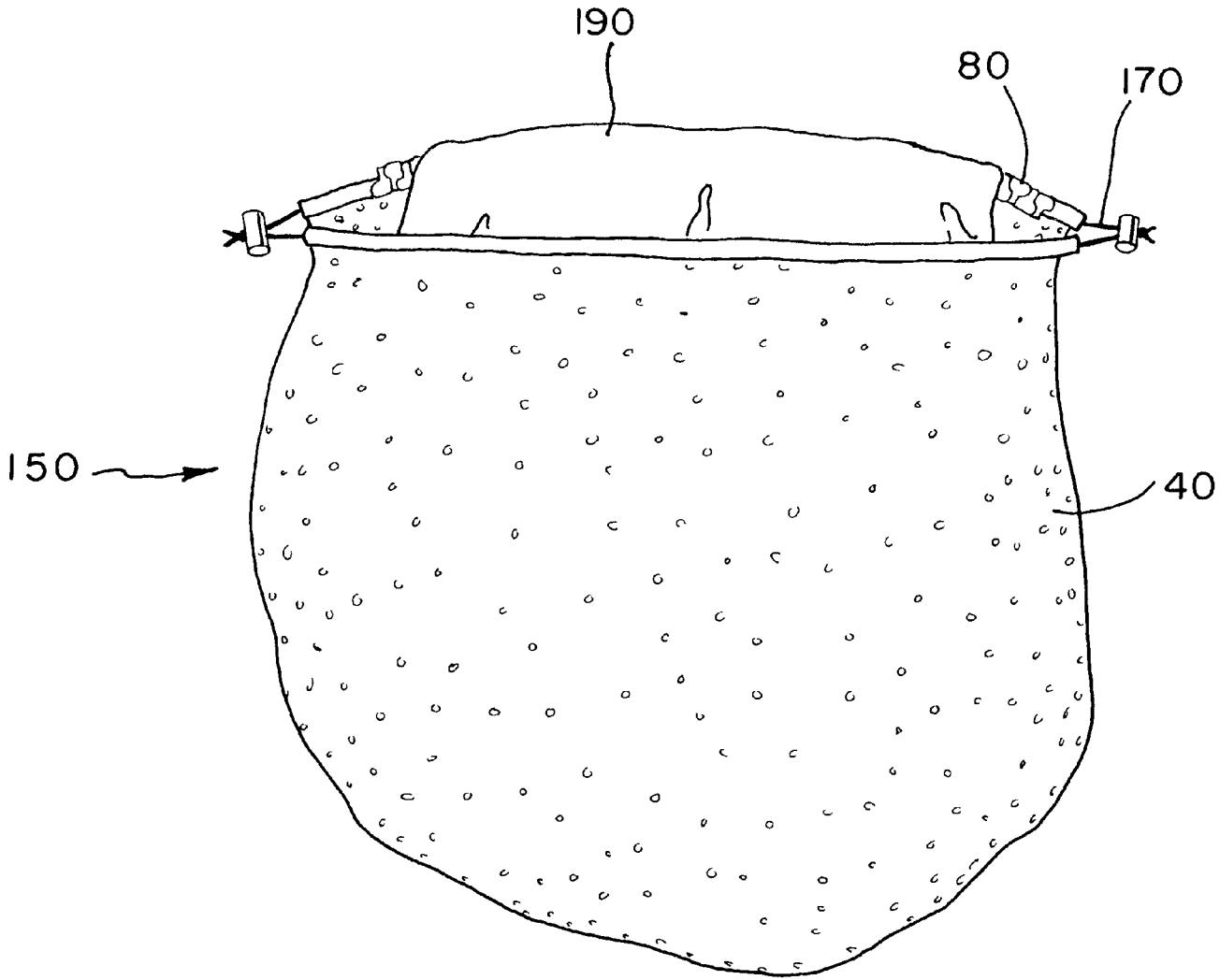
FIG. 11 is a front view of the jacket shown in FIG. 1 being stuffed into the bag formed from the hood shown in FIG. 1 while the jacket is still attached to the hood.

FIG. 3 depicts the ventilatory material inside the hood 40. The mesh bag is folded in half with its aperture on the bottom 45. The bag is then sewn along this fold 30 to the inside of the hood leaving the aperture open to form a pocket into which a hand can be inserted to turn the hood inside-out to form the bag. FIG. 4 is showing the process of unzipping the hood from the jacket 80 demonstrating its unattachability. The jacket may be stored inside the hood 10 whether or not the hood is unattached FIG. 8. FIG. 5 shows the unzipped hood standing alone still in its hood position as this is an easier position from which to demonstrate its conversion into the carrying bag 150. FIG. 6 is the next step in converting the hood into a carrying bag. The top back of the hood/bottom of the bag, is pushed down inside itself 160. FIG. 7 shows the completion of turning the hood inside-out to form the carrying bag 150. It is in this position that one can fully see the bag's ventilatory material 40 exposing its content to air. One can also see the drawstrings circumferencing the aperture of the carrying bag 175. FIG. 8 demonstrates the carrying capacity of the bag by showing the jacket and the pants folded and stored inside the bag 140. FIG. 9 conveys the bag's drawstring being cinched 170 to hold the jacket and pants securely inside the bag. FIG. 10 shows the bag being carried by the drawstring 170. FIG. 11 shows the jacket and pants being stuffed into the carrying bag while the jacket is still attached to the hood 190.

While only a few, preferred embodiments of the invention have been described, those of ordinary skill in the art will recognize that the embodiment may be modified and altered without departing from the central spirit and scope of the invention. Thus, the preferred embodiments described above are to be considered in all respects as illustrative and not restrictive, the scope of the invention being indicated by the following claims, rather than by the foregoing description, and all changes which come within the meaning and range of equivalents of the claims are intended to be embraced.

What is claimed is:

1. A ventilated waterproof hood, comprising:

(a) an inner ventilated material;

(b) an outer waterproof layer having an interior surface and an exterior surface, the outer waterproof layer comprising:

(i) at least two side portions;

(ii) a top of the head portion abutting the side portions, the top of the head portion comprising a front of the head portion and a back of the head portion;

(iii) a base of the neck portion; and (iv) a back portion, the back portion extending from the back of the head portion to the base of the neck portion and extending from one side portion to the other side portion, wherein the inner layer of ventilated material is attached to the back of the head and to the two side portions of the interior surface of the outer waterproof layer, and further wherein the inner ventilated material defines a ventilated pocket in the ventilated waterproof hood.

2. An outdoor garment, comprising (a) the ventilated waterproof hood according to claim 1; and (b) a jacket adapted for detachable attachment to the ventilated waterproof hood, wherein the base of the neck portion of the ventilated waterproof hood when detached from the jacket and turned inside-out forms a ventilated bag comprising the ventilated pocket.

3. The outdoor garment according to claim 2, wherein the ventilated bag is of a sufficient dimension to store the jacket.

4. The outdoor garment according to claim 2, further comprising a pair of pants.

5. The outdoor garment according to claim 4, wherein the ventilated bag comprises a drawstring, and the ventilated bag is cinchable to a closed position.

6. The outdoor garment according to claim 4, wherein the pair of pants comprises an adjustable waist band comprising a nylon cord.

7. The outdoor garment according to claim 4, wherein the jacket and the pair of pants are of the same color.

8. The outdoor garment according to claim 2 wherein the jacket is waterproof.

9. The outdoor garment according to claim 8, wherein the jacket and hood comprise complementary zipper portions and the jacket further comprises a collar, wherein the collar of the jacket covers the zipper portion on the jacket.

10. The outdoor garment according to claim 8, wherein the ventilated bag comprises a drawstring and the drawstring provides a handle for the ventilated bag.

11. The ventilated waterproof hood according to claim 1, wherein the ventilated material is selected from the group of materials consisting of a nylon mesh material; a nylon cord weave; a pliable plastic polymer braid or weave; and other breathable materials.

12. The ventilated waterproof hood according to claim 1, wherein the ventilated pocket of the hood comprises a bottom made of the inner ventilated material.

* * * * *